US007416456B1

(12) United States Patent
Gonring et al.

(10) Patent No.: US 7,416,456 B1
(45) Date of Patent: Aug. 26, 2008

(54) AUTOMATIC TRIM SYSTEM FOR A MARINE VESSEL

(75) Inventors: Steven J. Gonring, Slinger, WI (US); Randall J. Poirier, Howards Grove, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/653,031

(22) Filed: Jan. 12, 2007

(51) Int. Cl.
*B63H 23/00* (2006.01)

(52) U.S. Cl. ..... 440/1; 440/53

(58) Field of Classification Search ..... 440/1, 440/53, 61 G, 61 T
See application file for complete search history.

(56) References Cited

U.S. PATENT DOCUMENTS 4,318,699 A * 3/1982 Wenstadt et al. ..... 440/1
4,565,528 A 1/1986 Nakase ..... 440/1
4,824,407 A * 4/1989 Torigai et al. ..... 440/1
4,861,292 A 8/1989 Griffiths et al. ..... 440/1
4,931,025 A 6/1990 Torigai et al. ..... 440/1
4,939,660 A 7/1990 Newman et al. ..... 364/442
5,171,172 A * 12/1992 Heaton et al. ..... 440/1
5,352,137 A 10/1994 Iwai et al. ..... 440/1
5,366,393 A 11/1994 Uenage et al. ..... 440/1
6,273,771 B1 * 8/2001 Buckley et al. ..... 440/84
6,997,763 B2 2/2006 Kaji ..... 440/1

* cited by examiner

*Primary Examiner*—Lars A Olson
(74) *Attorney, Agent, or Firm*—William D. Lanyi

(57) ABSTRACT

An automatic trim control system changes the trim angle of a marine propulsion device as a function of the speed of the marine vessel relative to the water in which it is operated. The changing of the trim angle occurs between first and second speed magnitudes which operate as minimum and maximum speed thresholds.

18 Claims, 7 Drawing Sheets

AUTOMATIC TRIM SYSTEM FOR A MARINE VESSEL

BACKGROUND OF THE INVENTION

1. Field of the Invention

The present invention is generally related to a propulsion system for a marine vessel and, more particularly, to a trim system that is automatically actuated as a function of the speed of the marine vessel.

2. Description of the Related Art

Those skilled in the art of marine propulsion devices and marine vessels are familiar with many different ways to control the trim angle of a marine propulsion device. The operational position of a marine vessel relative to the water is affected by several parameters. These include the trim angle of the marine propulsion device, such as an outboard motor, the angle of trim tabs if the marine vessel is equipped with trim tabs, and the speed of the marine vessel relative to the body of water in which it is operated. A preferred embodiment of the present invention is related to the trim angle of the marine propulsion device.

Those skilled in the art of marine propulsion and marine vessels are familiar with many different ways in which the marine propulsion device, such as an outboard motor or stem-drive unit, can be moved to affect its angular position relative to the marine vessel.

U.S. Pat. No. 4,565,528, which issued to Nakase on Jan. 21, 1986, describes a tilting mechanism for a marine propulsion device. Several embodiments of trim and tilt arrangements for outboard drives that adjust the trim condition of the outboard drive unit in response to drive thrust and/or velocity of the boat so as to provide the optimum flow resistance under all conditions are described.

U.S. Pat. No. 4,861,292, which issued to Griffiths et al. on Aug. 29, 1989, discloses a speed optimizing positioning system for a marine drive unit. A system for optimizing the speed of a boat at a particular throttle setting utilizes sensed speed changes to vary the boat drive unit position vertically and to vary the drive unit trim position. The measurement of boat speed before and after an incremental change in vertical position or trim is used in conjunction with a selected minimum speed change increment to effect subsequent alternate control strategies. Depending on the relative difference in before and after speeds, the system will automatically continue incremental movement of the drive unit in the same direction, hold the drive unit in its present position, or move the drive unit an incremental amount in the opposite direction to its minimum position. The alternate control strategies minimize the effects of initial incremental movement in the wrong direction, eliminate excessive position hunting by the system, and minimize drive unit repositioning which has little or no practical effect on speed.

U.S. Pat. No. 4,931,025, which issued to Torigai et al. on Jun. 5, 1990, describes a posture control device for a marine vessel. A number of embodiments of watercraft propulsion unit controls for optimizing watercraft performance and maintaining stability are described. Performance is optimized in the illustrated embodiments by adjusting the trim angle of the propulsion device and stability is maintained by changing either the trim condition or the speed of the propulsion unit. The desired posture may either be preset in response to an earlier stable condition or may be set upon reaching of optimum performance.

U.S. Pat. No. 4,939,660, which issued to Newman et al. on Jul. 3, 1990, discloses a fuel conserving cruise system for a marine drive unit. A system for optimizing the operating efficiency of a boat by balancing fuel consumption against cruising speed utilizes a comparison between engine speed and boat speed to effect automatic positioning of the drive unit. The measurements of boat and engine speed before and after an incremental change in vertical position or trim position are used to calculate the percent changes in boat speed and engine speed which, in turn, are used in conjunction with selected minimum and maximum incremental percentages to effect subsequent alternate control strategies.

U.S. Pat. No. 5,352,137, which issued to Iwai et al. on Oct. 4, 1994, describes an automatic position controller for marine propulsion systems. Several embodiments of automatic position controls for marine propulsion devices, wherein the lift condition of the propulsion device is adjusted in response to a sensed running condition of the watercraft such as changes in acceleration, speed or planing condition, are described.

U.S. Pat. No. 5,366,393, which issued to Uenage et al. on Nov. 22, 1994, describes an automatic trim controller for marine propulsion units. Several embodiments of automatic trim controls for marine outboard drives for maintaining the optimum trim angle under all running conditions are described.

U.S. Pat. No. 6,997,763, which issued to Kaji on Feb. 14, 2006, describes a running control device. The device sets an optimum trim angle automatically. The running control device includes a propulsion force control section that controls the propulsion force of the propulsion device. The running control device also includes a tilt angle control section that controls the tilt angle of the propulsion device.

The patents described above are hereby expressly incorporated by reference in the description of the present invention.

Those skilled in the art of marine vessel propulsion and control are familiar with many different ways in which the trim angle of a marine propulsion device can be used to change the operating characteristics of the vessel. In addition to many different types of automatic trim control systems, many manual trim control systems are known to those skilled in the art. In typical operation, the operator of a marine vessel can change the trim angle of the associated propulsion units as the velocity of the vessel changes. This is done to maintain an appropriate angle of the vessel on the water as it achieves a planing speed and as it increases its velocity over the water while on plane. It would be beneficial if a system could be provided that performs the trim operation automatically, as a direct function of vessel speed, without requiring intervention by the operator of the marine vessel. The change in trim angle of the propulsion unit, if automatically performed, would enhance the operation of the marine vessel as it achieves planing speed and as it further increases its velocity over the water while on plane.

SUMMARY OF THE INVENTION

A method for controlling the operation of a marine vessel, in accordance with a preferred embodiment of the present invention, comprises the steps of measuring a speed of the marine vessel and changing the trim angle of a marine propulsion device, relative to the marine vessel, to a trim angle magnitude which is selected as a function of the speed of the marine vessel. The method further comprises the steps of comparing the speed to first and second speed magnitudes and performing the changing step when the speed is less than the second speed magnitude and greater than the first speed magnitude.

In a particularly preferred embodiment of the present invention, it further comprises the steps of determining the depth of water in the vicinity of the marine vessel and performing the changing step when the depth is greater than a preselected magnitude. The first speed magnitude can be a planing speed of the marine vessel and the trim angle magnitude can be a linear function of the speed of the marine vessel between the first and second speed magnitudes. Alternatively, certain embodiments of the present invention change the trim angle magnitude in discreet steps. As a result, between the first and second speed magnitudes, the range of vessel velocity is divided into a discreet number of distinct velocity ranges which are each associated with a particular trim angle. This facilitates the procedure by requiring less duty cycle on the part of the hydraulic components used to change the trim angle of the marine propulsion unit. The preferred embodiment of the present invention can further comprise the step of selecting the trim angle magnitude from a plurality of trim angle values which are each associated with a speed value.

In certain embodiments of the present invention, it can further comprise the steps of monitoring the movement of the marine vessel and reversing the changing step when the movement indicates an improper trim angle of the marine propulsion device.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
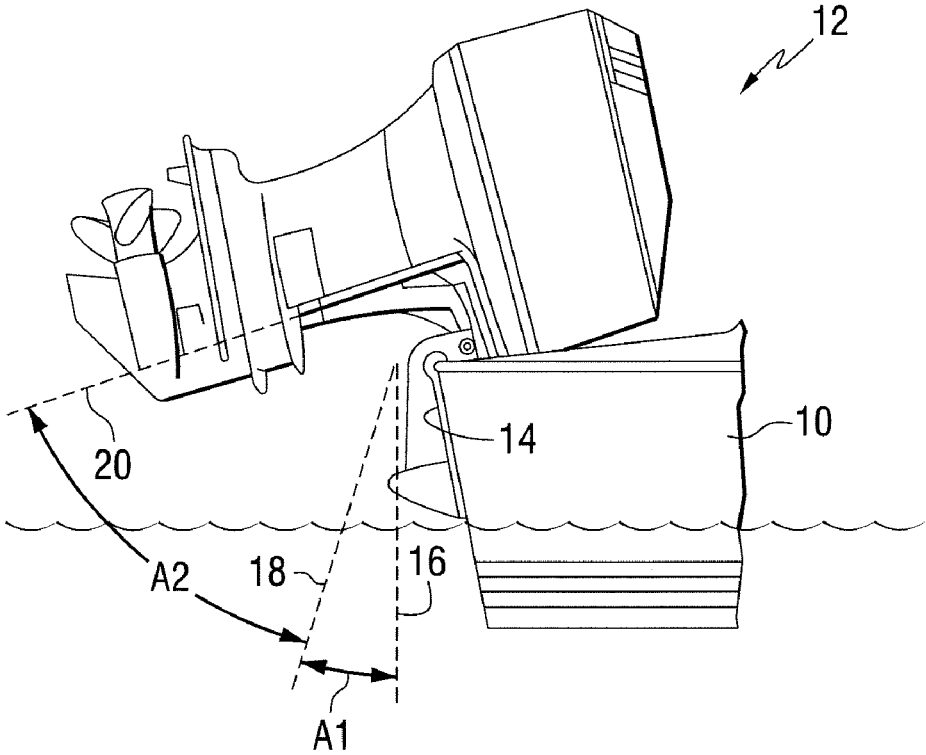
FIG. 1 shows a marine propulsion device attached to a marine vessel.

Throughout the description of the preferred embodiment of the present invention, like components will be identified by like reference numerals.

FIG. 1 is a schematic representation of a marine vessel 10 having a propulsion device 12, such as an outboard motor, attached to its transom 14. Dashed line 16 represents a generally vertical plane. Dashed line 18 represents an angle which is the maximum practical trim angle A1 of the outboard motor 12. Dashed line 20 represents a tilt angle A2 which is used when transporting the marine vessel 10 and marine propulsion device 12. During operation of the outboard motor, it is generally not moved to a position past the one indicated by dashed line 18. This is its maximum positive trim angle under normal operating conditions.

Figure 2:
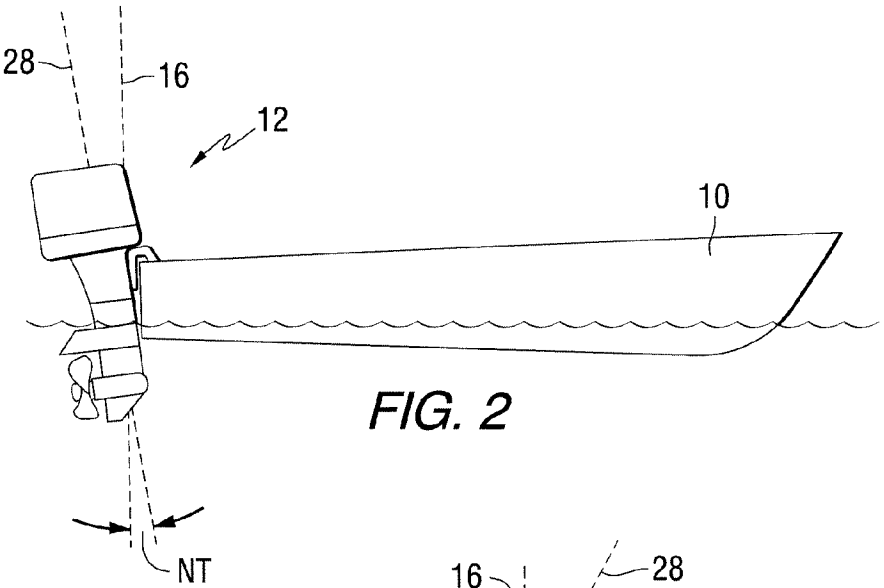
FIGS. 2 and 3 show trim angle limits associated with a typical marine propulsion device.

FIG. 2 shows a marine vessel 10 with its outboard motor 12 trimmed to a negative trim angle NT and relative to the vertical plane 16. This is represented by dashed line 28 that is intended to be generally coaxial with the driveshaft of the outboard motor. In contrast, FIG. 3 shows the outboard motor 12 trimmed outwardly to a positive trim angle PT which is represented between the generally vertical dashed line 16 and the dashed line 28 which is intended to be concentric with the driveshaft of the outboard motor.

Figure 3:
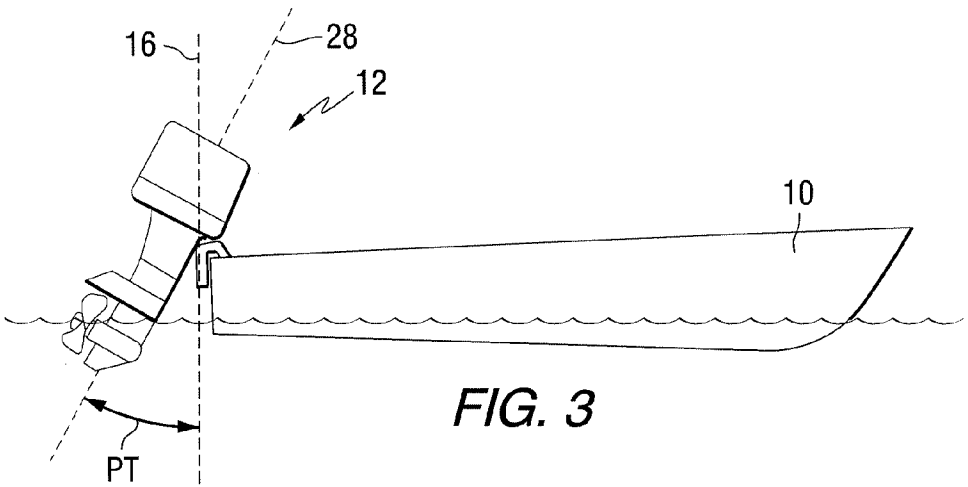

With continued reference to FIGS. 2 and 3, the configuration in FIG. 2 represents the configuration of the outboard motor 12 that is most often used when initially accelerating the marine vessel 10 from a stationary position. The configuration shown in FIG. 3 is most commonly used after the marine vessel 10 has achieved planing speed.

Figure 4:
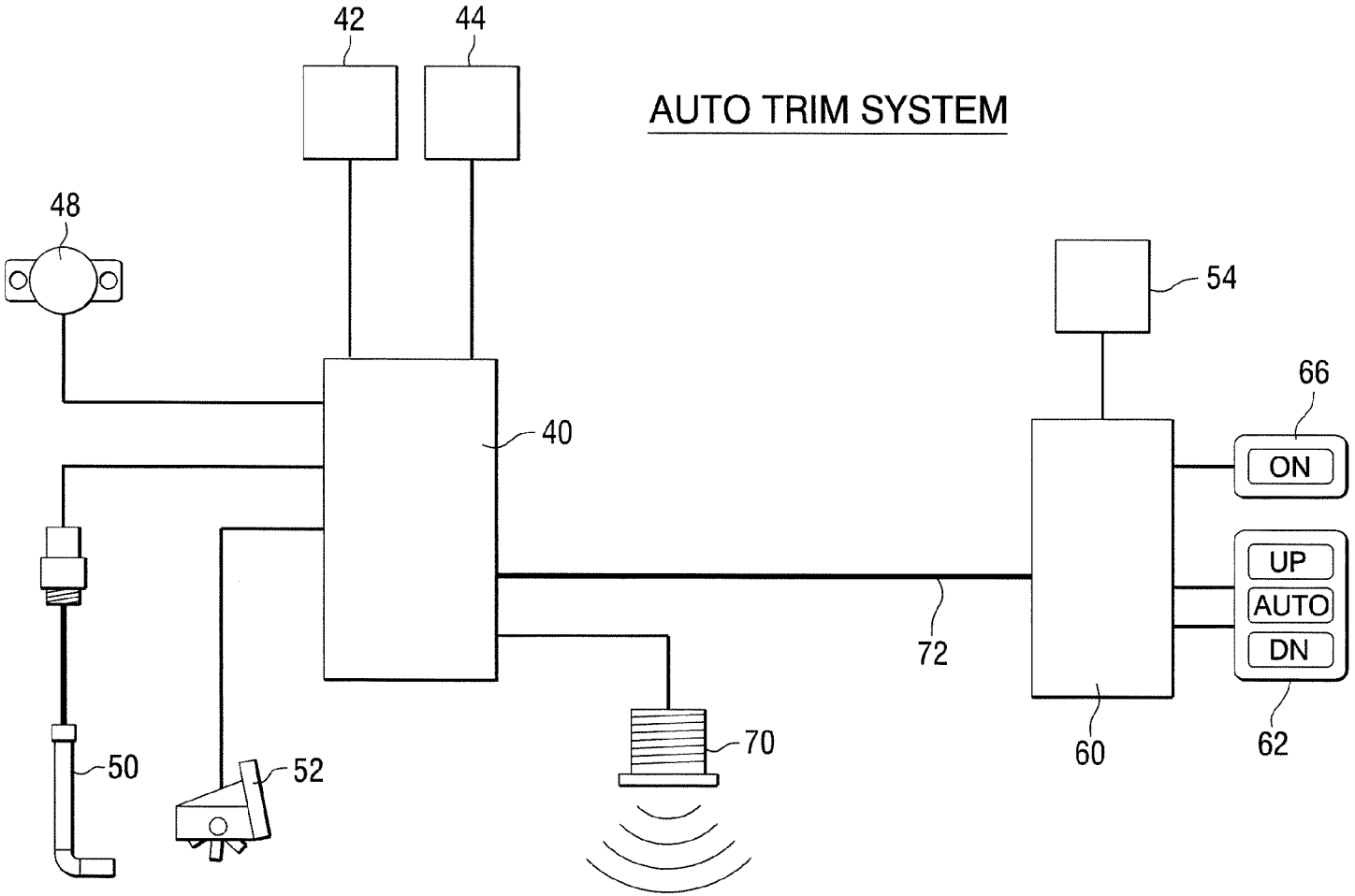
FIG. 4 is a schematic representation of a system that can perform the method of the present invention.

FIG. 4 is a schematic representation of a control system for a marine vessel. An engine control module 40, or ECM, is connected in signal communication with a trim up relay 42 and a trim down relay 44. These relays control a hydraulic system, in a manner generally known to those skilled in the art, for changing the trim angle of the outboard motor described above. In addition, a trim position sensor 48 provides signals to the engine control module 40 describing the current position of the outboard motor. Velocity of the marine vessel is measured in any one of various known ways. A pitot sensor 50 or a paddle wheel sensor 52 can be used to determine the current velocity of the marine vessel. In addition, a GPS (global positioning satellite) 54 can be used for these purposes. The system illustrated in FIG. 4 also shows a helm control module 60 which allows the operator to control the operation of the marine vessel. A trim control switch 62 facilitates the control of the trim angle of the marine propulsion device manually. An indicator 66 can be used to inform the operator of the marine vessel that the auto trim function is active.

With continued reference to FIG. 4, a depth sensor 70 can be provided to inform the operator and the engine control module 40 of the depth of water below the marine vessel. The components identified in FIG. 4 can be connected in signal communication with each other in various ways. One connection system can incorporate a serial bus 72, such as a CAN bus. The system illustrated in FIG. 4 enables the operation of the present invention.

Figure 5:
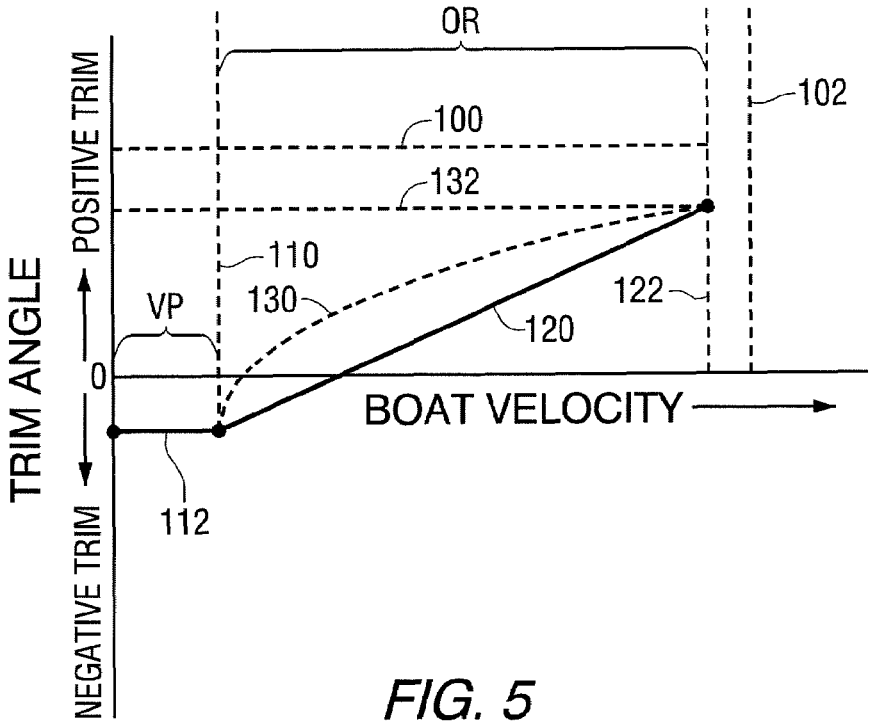
FIGS. 5, 6 and 7 show various relationships between trim angle magnitudes and boat velocity that can be achieved through the use of the present invention in its various embodiments.

FIG. 5 is a graphical representation showing the relationship between the trim angle of the marine propulsion device and the velocity of the marine vessel. Dashed line 100 represents the maximum positive trim angle PT of the marine propulsion device 12, as described above in conjunction with FIGS. 2 and 3. Dashed line 102 represents the maximum velocity of the marine vessel 10. Dashed line 110 represents the planing speed of the marine vessel. Line 112 represents the change in velocity of the marine vessel 10 from a stationary condition to the achievement of planing speed at dashed line 110. This increase in velocity is identified as VP in FIG. 5. In a preferred embodiment of the present invention, the trim angle of the marine propulsion device 12 is maintained at a negative magnitude such as that identified as NT in FIG. 2. This negative trim angle NT is maintained until the marine vessel reaches planing speed 110. Then, it is increased as a function of boat speed as indicated by line 120 in FIG. 5. This continues until the marine vessel achieves a velocity which is represented by dashed line 122. It can be seen that this velocity represented by dashed line 122 is less than the maximum velocity 102 of the marine vessel. The range of speeds between dashed lines 110 and 122 is identified as its operating range OR between first and second speed magnitudes during which the trim angle is changed, according to a preferred embodiment of the present invention, as a function of the boat velocity. In FIG. 5, this rate of change is linear as represented by line 120. However, as represented by dashed line 130, this relationship need not be linear in all applications. Dashed line 132 represents the maximum trim, during automatic trim operation, that is achieved when the marine vessel achieves the second speed magnitude 122. In a preferred embodiment of the present invention, maximum velocity 102 and maximum trim angle 100 are intentionally avoided. Beyond dashed lines 122 and 132, the operator can manually change the trim angle.

With continued reference to FIG. 5, it should be understood that the relationship between trim angle and boat speed, between the first and second speed magnitudes 110 and 122, would preferably be accomplished in discreet steps. In other words, although the overall relationship may be linear as represented by line 120 between dashed lines 110 and 122, the overall linearity may be accomplished by changing the trim angle in a finite number of steps. In other words, the change in trim angle from the velocity represented by dashed line 120 to the trim angle 132 at the velocity represented by dashed line 122 may comprise, for example, twenty velocity ranges which are each associated with a particular trim angle. As the velocity of the boat increases, the trim angle would then be changed in discreet increments. The advantage of this particular approach is to reduce the cycle time of the hydraulic pump and other components used to physically move the outboard motor to achieve the desired trim angles associated with the particular instantaneous velocity of the boat.

With continued reference to FIG. 5, a preferred embodiment of the present invention would maintain a trim angle identified by line 120, for example, regardless of whether the boat velocity is increasing or decreasing. In other words, as the boat velocity decreases, from dashed line 122, the trim angle would be selected as a function of line 120 until the boat velocity reached a magnitude equivalent to dashed line 110. Similarly, if dashed line 130 was alternatively used, the trim angle as a function of boat velocity would always identify a point on dashed line 130.

Figure 6:
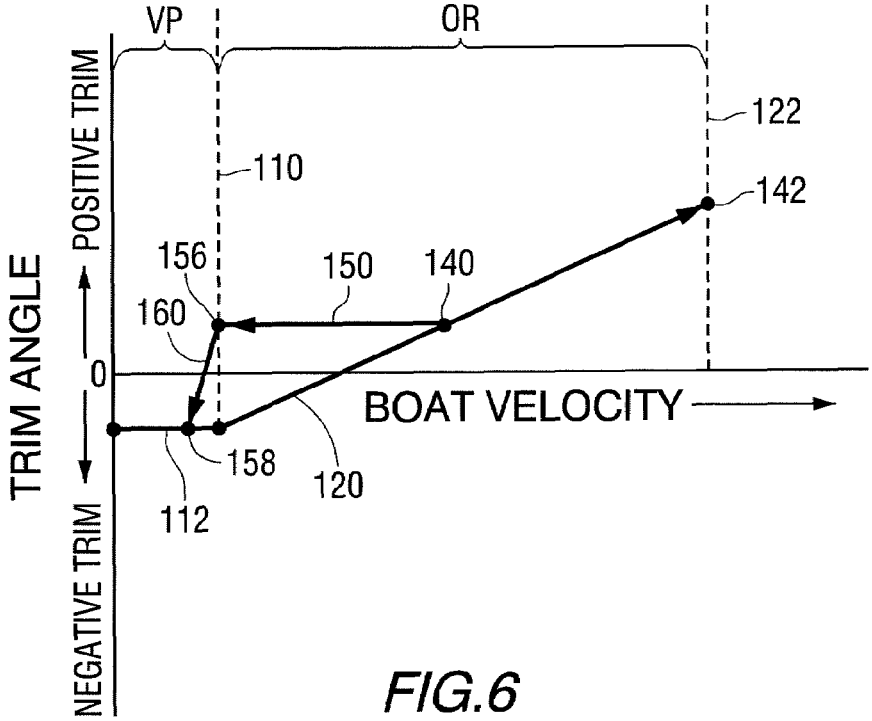

FIG. 6 shows an alternative method that is also within the scope of the present invention. As boat velocity increases from dashed line 110, which is typically its planing speed, and achieves a velocity greater than that indicated by point 140, the trim angle may not be controlled in the manner described above in conjunction with FIG. 5. As an example, between points 140 and 142, the present invention may maintain a trim angle as a function of the boat velocity that would continually be on line 120. However, below the velocity represented by point 140, an alternative embodiment of the present invention could follow line 150 instead of line 120. This decreasing velocity represented by arrow 150 would maintain a constant or relatively constant trim angle until the velocity reaches some preselected magnitude, such as the planing speed 110, at which point the trim angle would be decreased between points 156 and 158. It should be understood that this is an alternative modification of the present invention to be used during deceleration of the marine vessel. This alternative embodiment is in response to the fact that many marine vessels maintain a planing condition, during deceleration, at velocities below the required planing speed necessary to achieve a planing condition during acceleration. The maintaining of the trim angle, along arrow 150, continues until the boat reaches a preselected velocity at which time it is rapidly decreased along arrow 160.

Figure 7:
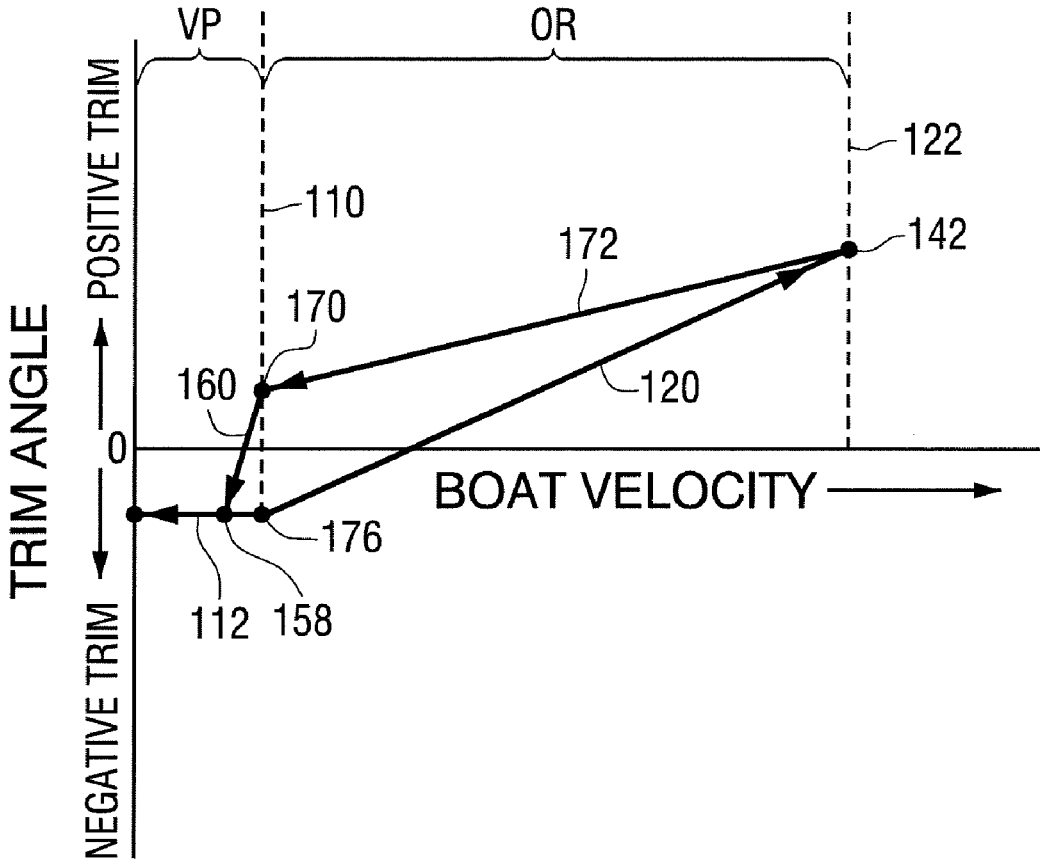

FIG. 7 illustrates another alternative embodiment of the present invention. During acceleration, the relationship between trim angle and boat velocity typically follows the lines identified by reference numerals 112 and 120 until achieving the boat velocity at point 142. During deceleration, the embodiment shown in FIG. 7 follows arrow 172 to point 170 and then the trim angle is decreased rapidly as represented by arrow 160 in FIG. 7. During acceleration, at planing speed 110, the relationship passes through the point identified by reference numeral 176. However, during deceleration the relationship of trim angle and boat velocity passes through the point identified by reference numeral 170 and then 158 as the boat decelerates to a stationary condition.

Figure 8:
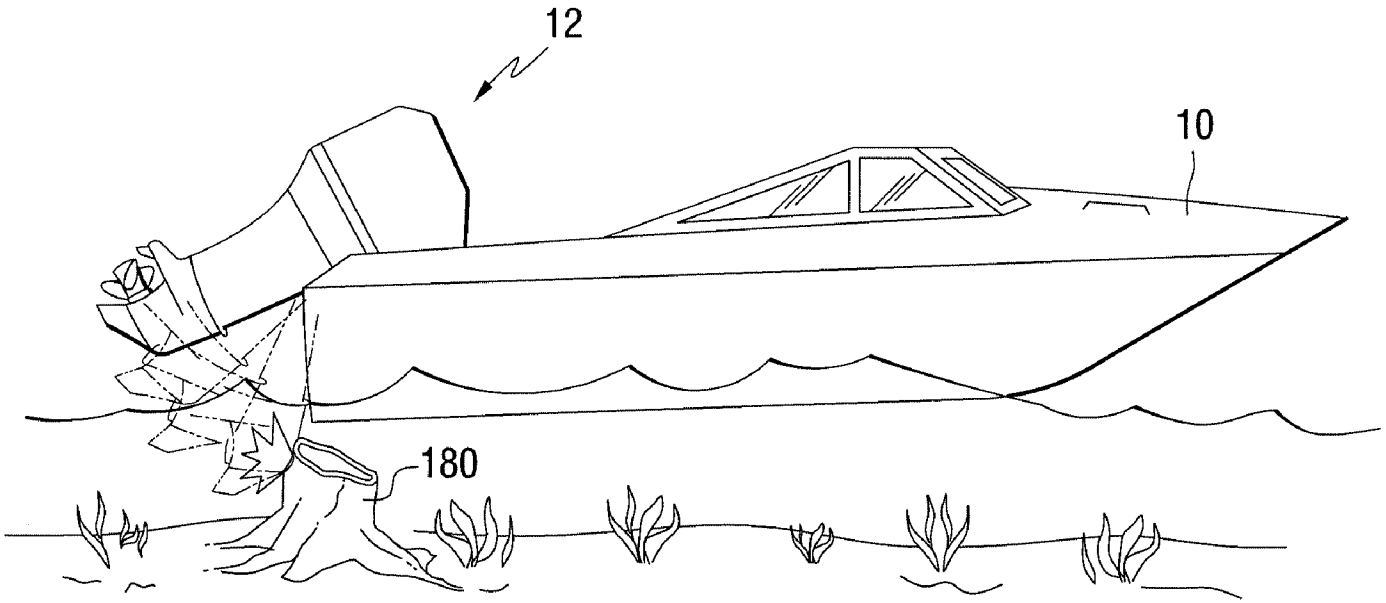
FIG. 8 illustrates a marine vessel in a shallow depth environment.

FIG. 8 illustrates a marine propulsion device 12 striking an underwater object 180 when the boat is operated in shallow water. In order to respond to this possibility of contact between the marine propulsion device and potential underwater objects, an alternative embodiment of the present invention could react to the existence of shallow depth below the marine vessel 10 by not trimming the marine propulsion down as described above in conjunction with FIGS. 6 and 7.

Figure 9:
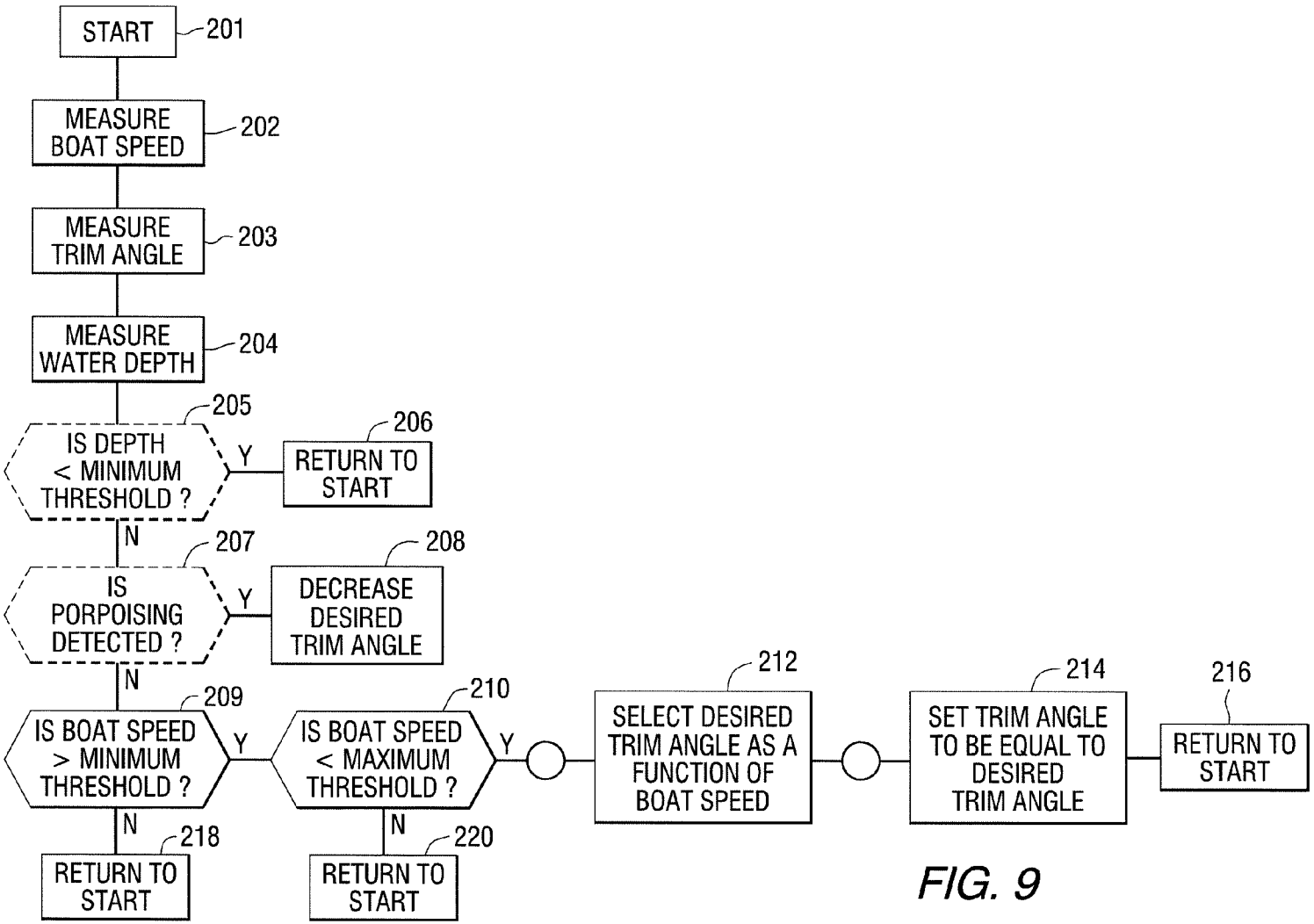
FIG. 9 is a flowchart showing various steps of a preferred embodiment of the present invention.

FIG. 9 shows a functional flow chart describing some of the steps of the present invention. It should be understood that various portions of the present invention are optional and can be included or eliminated from certain alternative embodiments.

Beginning at functional block 201, the boat speed is measured at functional block 202 and the trim angle is measured at functional block 203. The water depth can be measured, at functional block 204 in certain embodiments of the present invention. If the water depth is less than a minimum threshold, as determined at functional block 205, the present invention can either return to the starting position, as indicated at functional block 206, return to a manual operation, or take corrective action such as raising the trim angle of the marine propulsion device. If the depth is above the minimum threshold, the system can check for improper movement of the marine vessel. This type of movement, which is often referred to as "porpoising" by those skilled in the art, can result from a trim angle that is set to a magnitude greater than appropriate for the type and speed of the marine vessel. This motion can be detected, as represented by functional block 207, by an accelerometer or other type of sensor which responds to the movement of the marine vessel in the manner typically referred to as "porpoising." If porpoising is detected, the trim angle can be decreased as indicated at functional block 208.

With continued reference to FIG. 9, the system checks the boat speed magnitude relative to a minimum threshold at functional block 209 and a maximum threshold at functional block 210. If the boat speed is between the minimum and maximum thresholds, the present invention selects a desired trim angle at functional block 212 as a function of the boat speed. This can be done through the use of a lookup table or, alternatively, through the use of a mathematical function that derives a trim angle as a function of boat speed between the first and second boat speeds described above. Then the trim angle is set to be equal to the desired trim angle at functional block 214 and the system returns to the start as indicated by functional block 216. If either of the inquiries at functional blocks 209 and 210 resulted in a negative answer, the system returns to the start position as indicated by functional blocks 218 and 220.

With continued reference to FIGS. 1-9, it can be see that the method for controlling the operation of a marine vessel, in accordance with preferred embodiments of the present invention, comprises the steps of measuring a speed of the marine vessel, such as through the use of a GPS 54, a pitot device 50, or a paddle wheel device 52. It also comprises the step of changing the trim angle of the marine propulsion device 12 relative to the marine vessel 10 to a trim angle magnitude which is selected as a function of the speed of the marine vessel. It should be understood that the present invention selects the trim angle as a function of the marine vessel speed and not as a function of the engine speed or any other characteristic or parameter relating to the marine vessel. As such, it is able to respond to the actual performance of the marine vessel. Regardless of the loading of the boat, the propeller pitch, or the gear ratio of the marine drive unit, the trim angle is set as a function of the actual velocity of the marine vessel. Therefore, the operator of the marine vessel can be assured that as the velocity is changed, the trim angle will be changed accordingly. This change is performed between the first and second boat speeds described above. The method of the present invention is further comprises the steps of comparing the speed of the boat to first and second speed magnitudes, 110 and 122. The changing step is performed when the speed of the boat is less than the second speed magnitude 122 and greater than the first speed magnitude 110.

In alternative embodiments of the present invention, it can further comprise the step of determining the depth of water in the vicinity of the marine vessel 10 and performing the changing step when the depth is greater than a preselected magnitude. The first speed magnitude 110 can be a planing speed in a preferred embodiment of the present invention. The trim angle magnitude can be a linear function of the speed of the marine vessel between the first and second speed magnitudes. Alternatively, it can be a step function which utilizes a finite number of discreet speed ranges which are each associated with a discreet trim angle magnitude. A preferred embodiment of the present invention can further comprise the step of selecting the trim angle magnitude from a plurality of trim angle values which are each associated with a speed value. In a preferred embodiment of the present invention, it further comprises the step of monitoring the movement of the marine vessel 10, such as with an accelerometer, and reversing the changing step when the movement indicates an improper trim angle of the marine propulsion device 12. This indication can indicate the "porpoising" action of the marine vessel.

Although the present invention has been described in particular detail and illustrated to show several preferred embodiments, it should be understood that alternative embodiments are also within its scope.

We claim:

1. A method for controlling the operation of a marine vessel, comprising the steps of:

measuring a speed of said marine vessel;

changing the trim angle of a marine propulsion device, relative to said marine vessel, to a trim angle magnitude which is selected as a function of said speed of said marine vessel;

comparing said speed to a first speed magnitude;

comparing said speed to a second speed magnitude, said second speed magnitude being greater than said first speed magnitude by a given difference corresponding to an auto trim interval in a plot of boat velocity versus trim angle during which auto trim angle said trim angle magnitude is selected as a function of said speed of said marine vessel; and performing said changing step during said auto trim interval when said speed is less than said second speed magnitude and greater than said first speed magnitude.

2. The method of claim 1, further comprising:

determining the depth of water in the vicinity of said marine vessel; and performing said changing step when said depth is greater than a preselected magnitude.

3. The method of claim 1, wherein:

said first speed magnitude is a planing speed of said marine vessel.

4. The method of claim 1, wherein:

said trim angle magnitude is a linear function of said speed of said marine vessel between said first and second speed magnitudes.

5. The method of claim 1, further comprising:

selecting said trim angle magnitude from a plurality of trim angle values which are each associated with a speed value.

6. The method of claim 1, wherein:

said function is a linear function.

7. The method of claim 1, further comprising:

monitoring the movement of said marine vessel; and reversing said changing step when said movement indicates an improper trim angle of said marine propulsion device.

8. A method for controlling the operation of a marine vessel, comprising the steps of:

measuring a speed of said marine vessel;

comparing said speed to a first speed magnitude;

comparing said speed to a second speed magnitude; and changing the trim angle of a marine propulsion device, relative to said marine vessel, to a trim angle magnitude which is selected as a function of said speed of said marine vessel when said speed is greater than said first magnitude and less than said second speed magnitude, said function being a step function in which each of a plurality of steps of changing said trim angle is associated with a preselected change in speed, said second magnitude being greater than said first speed magnitude by a given difference corresponding to an auto trim interval in a plot of boat velocity versus trim angle during which auto trim interval said trim angle magnitude is selected as a function of said speed of said marine vessel, said plurality of changing steps occurring during said auto trim interval.

9. The method of claim 8, further comprising:

determining the depth of water in the vicinity of said marine vessel; and performing said changing step when said depth is greater than a preselected magnitude.

10. The method of claim 9, wherein:

said trim angle magnitude is a linear function of said speed of said marine vessel between said first and second speed magnitudes.

11. The method of claim 8, further comprising:

selecting said trim angle magnitude from a plurality of trim angle values which are each associated with a speed value.

12. The method of claim 8, further comprising:

monitoring the movement of said marine vessel; and reversing said changing step when said movement indicates an improper trim angle of said marine propulsion device.

13. A method for controlling the operation of a marine vessel, comprising the steps of:

measuring a speed of said marine vessel;

changing the trim angle of a marine propulsion device, relative to said marine vessel, to a trim angle magnitude which is selected as a function of said speed of said marine vessel;

comparing said speed to a first speed magnitude;

comparing said speed to a second speed magnitude said second speed magnitude being greater than said first speed magnitude by a given difference corresponding to an auto trim interval in a plot of boat velocity versus trim angle during which auto trim interval said trim angle magnitude is selected as a function of said speed of said marine vessel;

determining the depth of water in the vicinity of said marine vessel; and performing said changing step during said auto trim interval when said speed is less than said second speed magnitude and greater than said first speed magnitude and when said depth is greater than a preselected magnitude.

14. The method of claim 13, wherein:

said first speed magnitude is a planing speed of said marine vessel.

15. The method of claim 13, wherein:

said trim angle magnitude is a linear function of said speed of said marine vessel between said first and second speed magnitudes.

16. The method of claim 13, further comprising:

selecting said trim angle magnitude from a plurality of trim angle values which are each associated with a speed value.

17. The method of claim 16, wherein:

said function is a step function.

18. The method of claim 17, further comprising:

monitoring the movement of said marine vessel; and reversing said changing step when said movement indicates an improper trim angle of said marine propulsion device.

* * * * *